US005796021A

United States Patent [19]

Longshore

[11] Patent Number: 5,796,021

[45] Date of Patent: Aug. 18, 1998

[54] PICK HOLDER FOR GUITARS AND OTHER STRINGED INSTRUMENTS

[76] Inventor: Larry E. Longshore, 3314 Siletz Hwy., Lincoln City, Oreg. 97367

[21] Appl. No.: 841,208

[22] Filed: Apr. 29, 1997

[51] Int. Cl.[6] ..... G10D 3/00

[52] U.S. Cl. ..... 84/329; D17/20

[58] Field of Search ..... 84/329, 322; D17/20, D17/99

[56] References Cited

U.S. PATENT DOCUMENTS

| | | | |
|---|---|---|---|
| 3,752,029 | 8/1973 | Watrous | 84/329 |
| 4,890,531 | 1/1990 | Tischer | 84/329 |
| 5,127,300 | 7/1992 | Silverman | 84/329 |
| 5,651,468 | 7/1997 | Irizarry | 84/329 |

*Primary Examiner*—Cassandra C. Spyrou
*Attorney, Agent, or Firm*—Olson & Olson

[57] ABSTRACT

An improved pick holder for releasable attachment to guitars and other stringed instruments is formed as a longitudinally elongated, single-piece body member, preferably molded of vinyl plastic, having a longitudinally extending pick-holding slot formed in its top and a pair of opposite downwardly-extending mounting legs arranged for releasable attachment by adhesive pads to the soundboard of a stringed instrument. The mounting surface area of the legs is reduced and the body member is supported above and out of contact with the instrument with an open, air space provided therebetween to restrict any damping of the normal soundboard vibration and to limit vibrational interaction between the pick holder and the instrument.

3 Claims, 1 Drawing Sheet

PICK HOLDER FOR GUITARS AND OTHER STRINGED INSTRUMENTS

BACKGROUND OF THE INVENTION

The invention relates to pick holders for guitars and the like, and more particularly to pick holders arranged to be mounted on a stringed instrument for releasably holding a pick between uses during operation of the stringed instrument.

Pick holders adapted for attachment to the body of a stringed musical instrument such as a guitar are well known in the art as illustrated in U.S. Pat. Nos. 3,752,029 (Watrous); 4,890,531 (Tischer); and 5,127,300 (Silverman). All of the above references disclose pick holder structures that utilize large, flat, full-contacting mounting base structures that require a significant and substantial surface contact area with the stringed instrument which can adversely affect and dampen the sound vibration and resulting acoustic quality of the instrument. Many pick holders of the prior art also have involved structures which require physical alteration of the instrument to accommodate installation of the holder thereonto. The applicant is aware of no pick holder structure provided heretofore that is arranged with a mounting structure that is configured specifically to permit installation onto the soundboard of a stringed instrument without adversely effecting the otherwise normal, inherent operational characteristics of the sound board itself.

Moreover, pick holders provided heretofore in the art have generally comprised rather complicated assemblies of parts which are expensive to produce and/or include structural elements which themselves are subject to easy breaking or damage during use of the instrument and which also are subject to their own vibrational activity consequent of the operation of the soundboard during playing of the instrument.

SUMMARY OF THE INVENTION

In its basic concept, this invention provides a simplified and improved pick holder having a unitary, one-piece body member that incorporates a projecting mounting base arrangement having a significantly reduced mounting surface area for mounting contact with the soundboard of a stringed instrument and for elevated, non-contacting disposition of the pick holder body member above the surface of the soundboard.

It is by virtue of the foregoing basic concept that the principal objective of this invention is achieved; namely, the provision of a pick holder which, by virtue of its specific construction, can be operatively attached to the soundboard of a stringed instrument without disrupting or altering the basic vibrational and operational characteristics of the sound board of the instrument.

Another object of this invention is the provision of a pick holder of the class described which has no structure that can provide any interfering, sympathetic vibrational movement in response to the action of the soundboard to which the pick holder is attached.

Another object of this invention is the provision of a pick holder of the class described in which an open air space is provided between the pick holder body member and the surface of the instrument to further reduce vibrational interaction therebetween.

Still another object of this invention is the provision of a pick holder of the class described which holds a pick in a condition whereby it is positioned so that a performer may grasp it properly for immediate use, and said pick holder may is be easily moved to other instruments as desired, without damage to an instrument from which it is removed.

A further object of this invention is the provision of a pick holder of the class described which is of extremely simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 3:
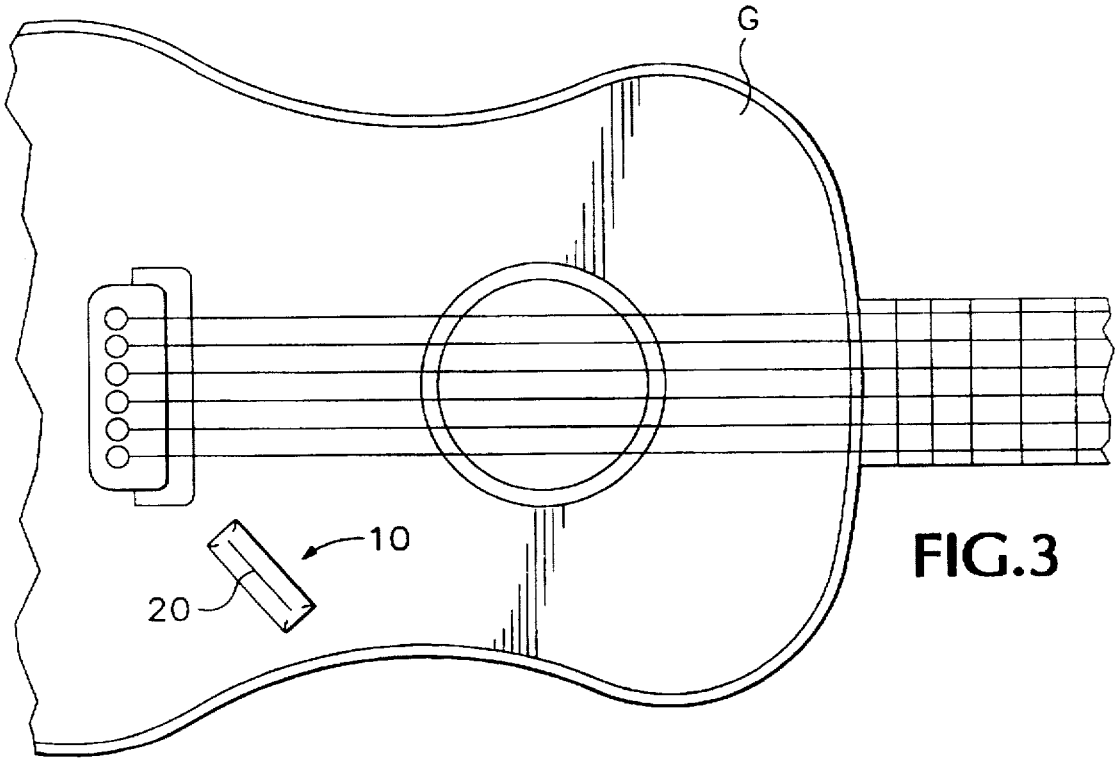
FIG. 3 is a fragmentary plan view of a guitar mounting the pick holder of this invention in one desired location on its sound board.

As shown in FIG. 3 of the drawings a pick holder generally indicated at 10 is provided for releasable mounting at a desired, user-selected location on a guitar G or other such stringed instrument. In the preferred embodiment illustrated herein, the pick holder 10 of the present invention comprises an elongated, unitary member, preferably molded in one piece of vinyl plastic material in the form of an upper, longitudinally elongated block-like body member 12 configured with a depending mounting base means having a reduced mounting surface area arranged for attachment contact with the surface of the instrument.

As shown, the mounting base means in this particular embodiment comprises a pair of spaced-apart, downwardly extending base leg members 14 configured to project a spaced distance below the bottom edge 16 of the body member 12. The legs terminate in ends which provide a reduced base attachment surface area that permits a preferably minimal but sufficient mounting "footprint" which is adequate for positively mounting the pick holder securely to the surface of an instrument with the pick holder body member disposed above and out of contact with the surface of the instrument, and forming an open, air space therebetween. The bottom terminal ends of the leg members 14 mount adhesive pads which may be in the form of easily replaceable, double sided, pressure sensitive tape 18 having a tack strength that is sufficient to positively secure the pick holder to the surface of the instrument for use, while also permitting removal of the pick holder from the instrument for repositioning thereon without damaging the surface of the instrument itself.

As seen, in the particular embodiment illustrated the mounting means is in the form of a pair of longitudinally-opposite, end leg members 14 which in this case secure the pick holder to the instrument at two, spaced apart points providing an open, air space therebetween. This arrangement provides a very secure mount on the instrument and also accommodates for any curvature of the surface to which the pick holder is attached. However it is to be understood that this particular mounting configuration, although a preferred form, is intended to be merely illustrative of the purpose. For example, a single projecting leg member may if desired be provided so as to depend centrally from the body member, or alternately from one of its ends or along one or both sides, somewhat in pedestal-fashion, to provide a reduced mounting surface while supporting the body member 12 above and out of contact with the surface of a stringed instrument with an open, air space therebetween. Accordingly, it will be understood by those skilled in the art that the essential elements of the mounting means comprise the supporting of an enlarged pick holder body member above and out of contact with the surface of a stringed instrument by a mounting member having a significantly reduced, instrument-contacting mounting surface area for attachment to the surface of the stringed instrument forming an open space between the instrument and the body member for limiting vibrational interaction therebetween. Preferably, the mounting surface area is as small as sufficient to accomplish the secure and positive mounting of the pick holder for the rigors of use, and may in certain configurations comprise as little as 5–10% of the surface "footprint" area of the base of the body member 12. This configuration also serves to limit vibrational interaction between the soundboard and the pick holder.

Figure 1:
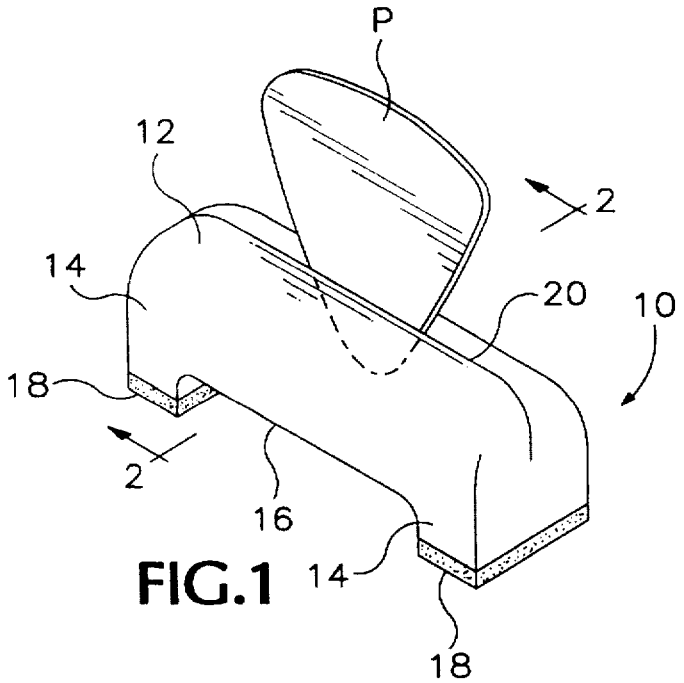
FIG. 1 is a perspective view of a pick holder embodying the features of this invention.
Figure 2:
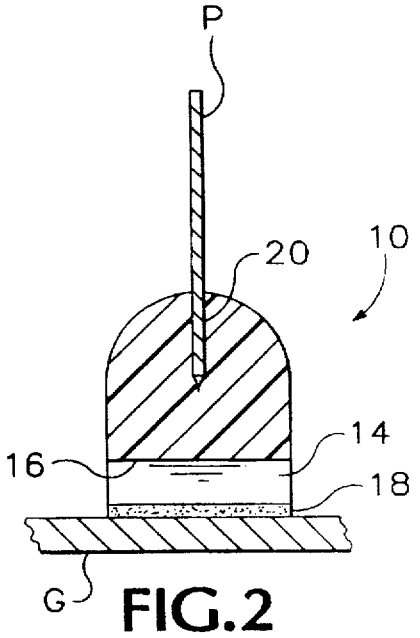
FIG. 2 is a fragmentary sectional view of the pick holder of FIG. 1, taken along the line 2—2 in FIG. 1.

The body member 12 is provided with pick retaining means for engaging and frictionally holding at least one pick securely but releasably in position for grasping and immediate use. As seen best in FIGS. 1 and 2, the body member 12 is provided with at least one elongated pick slot 20 extending along its length, the slot configured to frictionally grip the working tip portion of at least one pick and there support it with the broadened, holding end of the pick presented for grasping. In this manner, a performer is able to switch immediately and repeatedly from finger style playing to flat picking throughout a musical arrangement, as well as having immediate, properly positioned access to a replacement pick in the event one breaks or is dropped during playing of the instrument. Moreover, since the pick holder of this invention is arranged for mounting to virtually any available surface on a musical instrument, including the soundboard of the instrument, the user is able to position the pick holder of this invention wherever he wishes and finds most convenient and compatible with his playing style. Additionally, since the pick holder of this invention comprises a unitary body mass with no separate or projecting pick-engaging elements, the pick holder of this invention cannot produce its own transmitted or sympathetic vibrational noise consequent of its placement on an instrument soundboard, thereby allowing a user free and full choice of placement anywhere on the instrument as he may desire.

From the foregoing it will be apparent to those skilled in the art that various changes, other than those already described and discussed, may be made in the size, shape, type, number and arrangement of parts described hereinbefore without departing from the spirit of this invention and the scope of the appended claims.

Having thus described my invention and the manner in which it may be used I claim:

1. A pick holder for releasable attachment to an exterior surface of quitars and other stringed instruments, the pick holder comprising:

a) a body member configured as a block member having an upper side and an opposite, lower, base side, b) pick retaining means on the body member provided in said upper side of the block member for releasably engaging and frictionally holding the working tip end of at least one instrument pick for presentation of the pick in proper position for grasping and immediate use, and c) body member mounting means on the body member for adherably engaging an exterior surface of a stringed instrument to releasably secure the body member to the exterior surface with the block member supported a spaced distance from the exterior surface of the instrument and forming an open air space between said exterior surface and the lower, base side of the body member.

2. The pick holder of claim 1 wherein said pick retaining means comprises at least one longitudinally extending slot provided in said block member, the slot configured to releasably receive and frictionally hold the working tip end of said at least one instrument pick inserted thereinto, and said body member mounting means comprises at least one projecting mounting leg member extending from the block member, the mounting leg member having a terminal end configured for attachment to the exterior surface of the stringed instrument with the block member disposed a spaced distance from the exterior surface of the instrument and forming an open air space therebetween.

3. The pick holder of claim 2 wherein the body member and said at least one projecting mounting leg member are formed as a single molded member, and said terminal end of the projecting leg member mounts an adhesive pad member arranged to releasably secure the pick holder to the exterior surface of the stringed instrument.

* * * * *

UNITED STATES PATENT AND TRADEMARK OFFICE

CERTIFICATE OF CORRECTION

PATENT NO. : 5,796,021

DATED : 18 August 1998

INVENTOR(S) : Larry E. Longshore

It is certified that error appears in the above-identified patent and that said Letters Patent is hereby corrected as shown below:

Column 2, line 2, "may is be" should read:
--may be--.

Signed and Sealed this

Tenth Day of November 1998

*Attest:*

*Attesting Officer*

BRUCE LEHMAN

*Commissioner of Patents and Trademarks*